US012116201B2

(12) United States Patent
Footz et al.

(10) Patent No.: US 12,116,201 B2
(45) Date of Patent: Oct. 15, 2024

(54) BEVERAGE POD FOR AGGLOMERATING MATERIAL

(71) Applicant: Nexe Innovations Inc., Surrey (CA)

(72) Inventors: Darren Joseph Footz, Surrey (CA); Kianoush Karimi Pour Kerman, Essex Junction, VT (US); Edmundo Paulino, Vancouver (CA); Diolan Borogay, Vancouver (CA)

(73) Assignee: Nexe Innovations Inc., Windsor (CA)

( * ) Notice: Subject to any disclaimer, the term of this patent is extended or adjusted under 35 U.S.C. 154(b) by 0 days.

(21) Appl. No.: 17/375,884

(22) Filed: Jul. 14, 2021

(65) Prior Publication Data

US 2022/0017294 A1 Jan. 20, 2022

Related U.S. Application Data

(60) Provisional application No. 63/051,665, filed on Jul. 14, 2020.

(51) Int. Cl.
*B65D 85/804* (2006.01)
*B65B 29/02* (2006.01)

(52) U.S. Cl.
CPC ..... *B65D 85/8046* (2013.01); *B65B 29/025* (2017.08)

(58) Field of Classification Search
CPC ..... B65D 85/804–8067; B65B 29/025
See application file for complete search history.

(56) References Cited

U.S. PATENT DOCUMENTS

2008/0216666 A1* 9/2008 Doglioni Majer .. A47J 31/0673 222/1
2017/0334623 A1* 11/2017 Gualandi ..... B65B 7/16

* cited by examiner

*Primary Examiner* — Iren A Thakur
*Assistant Examiner* — Chaim A Smith
(74) *Attorney, Agent, or Firm* — Perkins Coie LLP

(57) ABSTRACT

The present disclosure is directed to single use beverage dispensing containers or pods that are used to make beverages from materials that may have limited solubility. Beverage pods of the present disclosure may be made to break open along a bottom surface of the pod when the pod is placed into a beverage making machine. When the beverage pod capsule comes into contact with a piercing element of a beverage making machine, thinner or embossed parts of the beverage pod may be stressed and crack open forming a breakaway opening that exceeds the diameter of a hole in the beverage machine's piercing element. A flow of liquid provided to a top of the beverage pod would mix with a beverage making material and the liquid and the material could escape the pod through the breakaway opening in the beverage pod.

18 Claims, 7 Drawing Sheets

BEVERAGE POD FOR AGGLOMERATING MATERIAL

CROSS-REFERENCE TO RELATED APPLICATIONS

The present disclosure claims priority benefit of U.S. provisional patent application 63/051,665 filed Jul. 14, 2020, the disclosure of which is incorporated by reference herein.

BACKGROUND

Field of the Disclosure

The present disclosure is generally directed to single serve beverage cartridges that are sometimes referred to as beverage pods. More specifically, the present disclosure is directed to beverage pods that more effectively make beverages from materials that resist dissolving in liquids.

Description of the Related Art

Single-serve beverage cartridges have become a dominant method for serving beverages, especially hot beverages, in a variety of settings such as homes, offices, waiting rooms, hotel rooms and lobbies, and other places where people consume beverages. The rapid growth of single-serve beverage cartridges is driven by consumer preference for convenient, quickly prepared beverages in single-portion quantities, in a variety of flavors, beverage types (coffee, espresso, decaffeinated coffee, tea, decaffeinated tea, cider, hot cocoa/chocolate, bone broth, and even alcoholic beverages, such as, for example, Irish Coffee, Hot Toddy, Hot Buttered Rum, etc.). Even within a beverage type, such as coffee, there may be a plurality of roasts and associated roasters, flavor profiles, flavor additives, caffeine strengths, location or locations of origin, etc.

The convenience and variety of single serving beverage cartridges allows and encourages consumers to prepare and consume a plurality of beverages throughout the day. This pattern of consumption causes the rapid accumulation of used beverage cartridges wherever they are consumed. Due to the nature of single-serving beverage cartridges, a considerable amount of packaging waste is produced per beverage consumed compared to preparing beverages by traditional means, such as, for example, preparing a plurality of servings at once using bulk ingredients. Packaging waste, according to the United States Environmental Protection Agency (EPA), defines containers and packaging as products that are assumed to be discarded the same year the products they contain are purchased. The EPA further estimates that the majority of the solid waste are packaging products. Packaging waste contributes significantly to global pollution, the introduction of contaminants into the natural environment that cause adverse change, which poses a health risk many forms of life, including humans, other animals, plants, fungi, etc.

Single-serve beverage cartridges typically comprise several components made of various materials. The typical components of a single-serve beverage cartridge include, at least, a container, typically made from plastic such as polyethylene, a filter, typically made from plant fiber such as abacá fibers or other natural and synthetic fibers, and a container lid, typically made from food-grade aluminum foil, which is also commonly printed upon to include product labelling. Some beverage cartridges do not contain a filter, typically because the beverage material is readily soluble in hot water (such as, for example, hot cocoa). The container will usually comprise an opening on the top of the container, and a hollow cavity within which and across which a filter may be disposed. The container may also comprise an opening at on the bottom container. After the filter and beverage material are inserted into the container, the lid is then typically sealed over the container opening or openings. The sealed lid typically provides an airtight seal, preventing the exchange of gases between the environment and the interior of the container, thus preventing oxidation and/or spoilage of the beverage material.

In beverage cartridges that comprise a filter, the filter may separate the container into two chambers: a first chamber occupying the space within the container between the filter and the opening of the container, the first chamber for holding dry beverage ingredients such as, but not limited to, coffee, tea, or cocoa, for a single beverage serving; and (ii) a second chamber occupying the space within the container between the filter and the base of the container, the second chamber being on the opposite side of the filter to the first chamber. The purpose of the second chamber is typically to provide a space in which a fluid extractor of a beverage brewing device may be inserted into the bottom of the container, entering the second chamber and allowing the extraction of fluid from the cartridge without the fluid extractor entering the first chamber, such that fluid must flow through the beverage material and the filter before exiting the cartridge via the fluid extractor. However, the presence of the second chamber may significantly reduce the space within the container that can be occupied by beverage medium. This may be problematic as the total amount of beverage material disposed within the container may significantly contribute to the final concentration of the beverage, typically measured in Total Dissolved Solids (TDS).

Because of this, it may be advantageous to minimize the volume of the second chamber in order to maximize the volume on the third chamber, thereby maximizing the total volume available for beverage material. However, the fluid extractor is typically comprised of a sharp, hollow needle-like piercing element designed to easily pierce through the bottom of the container, such that if the second chamber is reduced in size, the fluid extractor may penetrate or damage the filter, allowing the beverage material to exit the first chamber, and ultimately exit the cartridge via the fluid extractor. Thus, in the event the fluid extractor penetrates or damages the filter, the beverage material may be transported into the final beverage, which may be undesirable to consumers (such as, for example, the presences of coffee grounds in a prepared cup of coffee) and may potentially damage the beverage brewing machine (for example, by way of clogging the fluid extractor with beverage material).

The cover is disposed over the opening of the container (which may be, for example, over the top of the container, and/or bottom of the container), and keeps the dry beverage ingredients within the container, as well as providing an airtight seal to prevent the oxidation and other types of degradation of the container's contents. In practice, a single-serving beverage cartridge is placed into a compartment of a brewing machine. The machine is activated such that a fluid injector penetrates the cover of the cartridge and a fluid extractor penetrates the base of the cartridge (which may also be a cover). The fluid injector injects a brewing medium (e.g. hot water) into the first chamber for extracting beverage components from the ingredients. The brewing medium containing the extracted beverage components percolates through the filter and into the second chamber. The brewing medium containing the extracted flavours is then extracted by the fluid extractor and finally dispensed as a drinkable beverage.

Currently, the container of a beverage cartridge for single-serve use is typically made from petroleum-based plastic materials which are neither biodegradable nor compostable. In some cases, the container may be made of petroleum biodegradable materials, such as Polybutylene adipate terephthalate (PBAT). While these materials may eventually biodegrade, they are not desirable for use in home or industrial composting settings, as they may pollute the compost with petroleum residue, microplastics, and other chemicals that may not be desirable for compost. Composting is the mixing of various decaying organic substances, such as dead plant matter, which are allowed to decompose to the point that various waste products of the composting process provide nutrients to be used as soil conditioners/fertilizers. Composting can be aerobic, anerobic, and/or vermicomposting, depending on the environment in which the compost is prepared. Aerobic composting is the decomposition of organic matter by microbes that require oxygen to process the organic matter. The oxygen from the air diffuses into the moisture that permeates the organic matter, allowing it to be taken up by the microbes. Anerobic composting is the decomposition of organic matter by microbes that do not require oxygen to process the organic matter. To be anerobic, the system must be sealed from the air, such as with a plastic barrier. Anerobic compositing produces an acidic environment to digest the organic material. Vermicomposting is the decomposition of organic matter by worms and other animals (such as soldier flies). A portion of the organic matter is converted to vermicast, or castings from the worms or other animals. The breakdown of the organic matter into vermicast yields an effective soil conditioner and/or fertilizer.

The cover of a beverage pod is typically made of a metal foil (e.g., aluminum) or a metal foil laminate which is glued to the top of the container. Generally, neither the metal foil of the cover nor the glue affixing the cover over the opening of the container is biodegradable, compostable or made from readily renewable resources. As a result, non-biodegradable and non-compostable beverage cartridges typically end up in landfills, thereby at least contributing to environmental concerns associated with disposal of trash. This may be especially problematic due to the fact that traditional means of brewing beverages, e.g., using solely beverage material and filter material, or a filtration device (such as a French press, or a wire mesh filter) may yield a completely compostable waste product (e.g., spent coffee grounds and potentially a used paper filter).

Attempts have been made to recycle plastic beverage pods in some cases. Recycling has many issues which effect the efficacy and practicality of these programs. The first is collection and transportation. Collection largely requires voluntary compliance by consumers. Some deposit programs encourage consumers to return recyclable materials, however this accounts for very few recyclable materials. Collection is further complicated by the need to further transport the materials to a facility which can process them. Many of these facilities are run by municipalities as recycling operations frequently lack economic viability without government subsidies. Recycling of plastics and other materials is further complicated by cross contamination and downcycling. Cross contamination is the presence of foreign materials not desired in the end product and can include materials such as other non-recyclable waste, or other recyclable wastes not compatible with the desired recycled material which can include other plastics. This requires sorting and cleaning of materials. This process can be partially automated; however, it also requires manual sorting and inspection which adds cost, reduces the amount of material that can be processed and inevitably results in a less pure product than when using virgin material. This frequently results in downcycling.

Downcycling is the term used to describe the reduction of quality in recycled materials compared to materials prior to being recycled. Impurities introduced during processing, from non-recyclable waste that could not be removed, or from other plastics and materials can make the resulting material unsuitable for use in their original applications. As such, the applications for recycled materials, especially plastics, are limited, as is the number of times that plastics can be recycled.

Beverage containers, such as instant beverage cups or pods, are particularly difficult to recycle. Not only do they have non-recyclable material contained within them that would first need to be removed, they are frequently comprised of at least two different materials, such as a plastic cup and an aluminum foil lid. When the lid is made of plastic, it is often a different type than the cup, and would require separation prior to processing when being recycled. This increases the complexity of the recycling operation, requiring at least three separate streams for each type of refuse, each requiring their own preparation. Furthermore, the small size of these beverage pods creates a disproportionate amount of effort required to recycle a small amount of material. The separation of materials would ideally be performed by the consumer prior to recycling; however, this inconvenience will inevitably result in consumers recycling the beverage containers without proper preparations, or failing to recycle the container at all, electing to discard the container as trash. One of the major advantages of using beverage pods is consumer convenience, such that a beverage can be prepare by simply inserting a cartridge into a machine that performs all other brewing functions. It is therefore undesirable to instruct consumers to disassemble and sort various materials from the beverage pod, and due to the diminutive size of beverage pods, this may not be physically possible for consumers without fine motor skills necessary to disassemble such an item. The result is a required step of preprocessing the containers before they can be recycled to ensure the materials are separated and the recyclable material sufficiently cleaned.

Plastics are traditionally sourced from petroleum. They are processed with chemicals to create polymers which can then be formed into shapes. Such polymers that are heated to be formed and then hold their shape when cooled are called thermoplastics. Many of the chemicals used to produce these polymers are inherently toxic and can leech into the contents. This is why few types of plastics are approved for use with foods. Some materials may be safe storing some types of food products, such as dry goods, however when a solvent is introduced, the chemicals in the plastic can go into solution. In the past, some plastics that were previously approved for use with foods have been found to leech chemicals, such as BPA (Bisphenol A). Other chemicals that can be found in plastics include thalates, antiminitroxide, brominated flame retardants and poly-fluorinated chemicals. Depending on the chemical and the manner in which the plastic is being used, it can cause problems including irritation in the eye, vision failure, breathing difficulties, respiratory problems, liver dysfunction, cancers, skin diseases, lung problems, headache, dizziness, birth defects, as well as reproductive, cardiovascular, genotoxic and gastrointestinal issues.

There has been a push from some governments to mandate composting and increase the amount of recycled material to reduce the amount of waste being incinerated or buried in landfills. Some laws such in the European Union, set specific targets, such as 65% of waste recycled by 2035. In the United States, there is no national law, but roughly half of states have some form of recycling law and municipalities may further add to these laws resulting in a varying patchwork of regulations and mandates. Some laws are very limited, requiring that some bottles and cans be recycled. Many of these states also add deposits to bottles, adding monetary value and incentive to returning them for recycling. Others require only specific recyclable materials be recycled, while others may be permitted to be discarded in the trash. Some states go further, mandating that compostable waste be disposed of properly, either in a home composter, or via an industrialized composting operation.

A further complication to composting plastics is that not all plastics break down the same. Some plastics, whether petroleum based or bioplastics, which originate from biomass, are biodegradable. Only a small subset of these are also compostable. The distinction lies in how quickly the plastic breaks down, and whether the process of degradation releases harmful chemicals into the environment. Compostable plastics typically degrade within 12 weeks, wherein biodegradable plastics will typically break down within 6 months. Ideally, compostable plastics would break down at the same rate as common food scraps, about 90 days.

Another class of plastics are OXO-degradable plastics. These are different than biodegradable plastics in that they are traditional plastics with additional chemicals which accelerate the oxidation and fragmentation of the materials under UV light and/or heat. This allows the plastics to break down more quickly, however the result is pollution from microplastics, as the plastic molecules themselves do not degrade any faster than their traditional plastic counterparts. There have been efforts in some jurisdictions to ban these plastics.

Agglomeration in soluble beverage material makes it difficult to get full amount of beverage material into final beverage. Certain types of beverage making materials have limited solubility in fluids and tend to clump together or collect in a mass or group unless these materials are exposed to sufficient agitation. A typical beverage machine may include a drain needle with a small opening 2-5 mm in diameter, though the opening may not be circular in shape. This opening functions to allow the liquid beverage solution from the interior of the beverage pod to exit the beverage pod for dispensation into the final beverage. However, soluble beverage material, such as, for example, a powdered form of Collagen protein. Collagen is a naturally occurring fibrous protein found in both humans and animals which provides structural support for bones, tendons, ligaments, and blood vessels, in addition to its role in the skin. Collagen is known to be the most abundant protein in the body. The basic structural unit of a collagen fiber is tropocollagen. It consists of a triple helix of three intertwined peptide chains of approximately 1000 amino acid residues. The basic polypeptide unit of the peptide chain is a repeating sequence of 3 amino acids, where every third residue is a glycine, and the other two alternate between proline and hydro proline. It is important to the stabilizing feature of the collagen fiber that the glycine residue is every third residue because its small side chain allows for tight coiling of the three helices, providing a strong stabilizing structure.

This is especially problematic with agglomerating materials such as nutraceutical material (e.g. Collagen protein) as the material might not have rapid solubility, especially in hot beverages, and moreover, the material is expensive compared to other types of soluble beverage material (e.g. cocoa), making the cost of failure much higher. These materials tend to agglomerate when exposed to fluids which can prevent the beverage material from exiting a beverage pod through the narrow opening of the outlet. Additionally, beverage material may clog the outlet causing machine failure.

There exists a need to create a beverage capsule which fully evacuates its contents while in use in a beverage machine, which may mean creating an article of manufacture which can expel contents through an aperture that exceeds the size of a typical beverage machine drain needle.

SUMMARY OF THE PRESENTLY CLAIMED INVENTION

The present disclosure is directed to single use beverage containers or pods that may be inserted into a beverage making machine when a beverage is made. This disclosure is also directed to methods for making single used beverage containers or pods. In a first embodiment, a beverage container includes a top portion that receives a liquid from a beverage making machine. This container may also include a bottom portion that includes a first part that is configured to break away from a second part of the container when an outlet of the beverage machine presses into the first part of the container. The breaking away of the first part of the container from the second part of the container may create an opening in the container. This beverage container may also include a beverage making material that is sealed within the container. A portion of the beverage making material may exit the container via the opening bypassing the outlet of the beverage machine prevent the beverage making material from remaining in the container when the liquid is received via the top portion of the container.

In a second embodiment, a method for making a beverage container includes fabricating a first portion of the beverage container, the first portion may include a side wall of the beverage container. This method may also include fabricating a bottom portion of the beverage container that includes a first feature configured to break away from a second feature of the beverage container when an output of a beverage making machine presses against the bottom portion of the beverage container. When a flow of fluid is provided to the beverage container, that fluid may flow past the side wall of the beverage container and out of the beverage container bypassing the output of the beverage making machine prevent the beverage making material from remaining in the container. The bypassing of the output may be based on the first feature breaking away from the second feature of the beverage container. This method may also include bonding the first portion of the beverage container to the second portion of the beverage container.

In a third embodiment, a method for making the beverage container includes fabricating a top portion of the beverage container and fabricating a second portion of the beverage container. Here, the second portion of the beverage container may include a side wall and a bottom of the beverage container. The bottom of the beverage container including a first feature configured to break away from a second feature of the beverage container when an output of a beverage making machine presses against the bottom portion of the beverage container. This method may also include placing a beverage making material in the beverage container. After the beverage material in placed in the container the top portion of the beverage container may be bonded to the second portion of the beverage container. When a flow of a fluid flows past the side wall of the beverage container and out of the beverage container, that flow may bypass the output of the beverage making machine prevent the beverage making material from remaining in the container based on the flow flowing around the output based on the first feature breaking away from the second feature of the beverage container.

BRIEF DESCRIPTIONS OF THE DRAWINGS

DETAILED DESCRIPTION

The present disclosure is directed to single use beverage dispensing containers or pods that are used to make beverages from materials that may have limited solubility. Beverage pods of the present disclosure may be made to break open along a bottom surface of the pod when the pod is placed into a beverage making machine. When the beverage pod capsule comes into contact with a piercing element of a beverage making machine, thinner or embossed parts of the beverage pod may be stressed and crack open forming a breakaway opening that exceeds the diameter of a hole in the beverage machine's piercing element. A flow of liquid provided to a top of the beverage pod would mix with a beverage making material and the liquid and the material could escape the pod through the breakaway opening in the beverage pod. A flow of this liquid and material could then flow into a cup of a person after which the person could continue mixing the ingredients until the beverage making material was sufficiently dispersed in the liquid. In addition, a deformed beverage pod could improve the mixing of the brewing fluid with the soluble beverage material.

Figure 1:
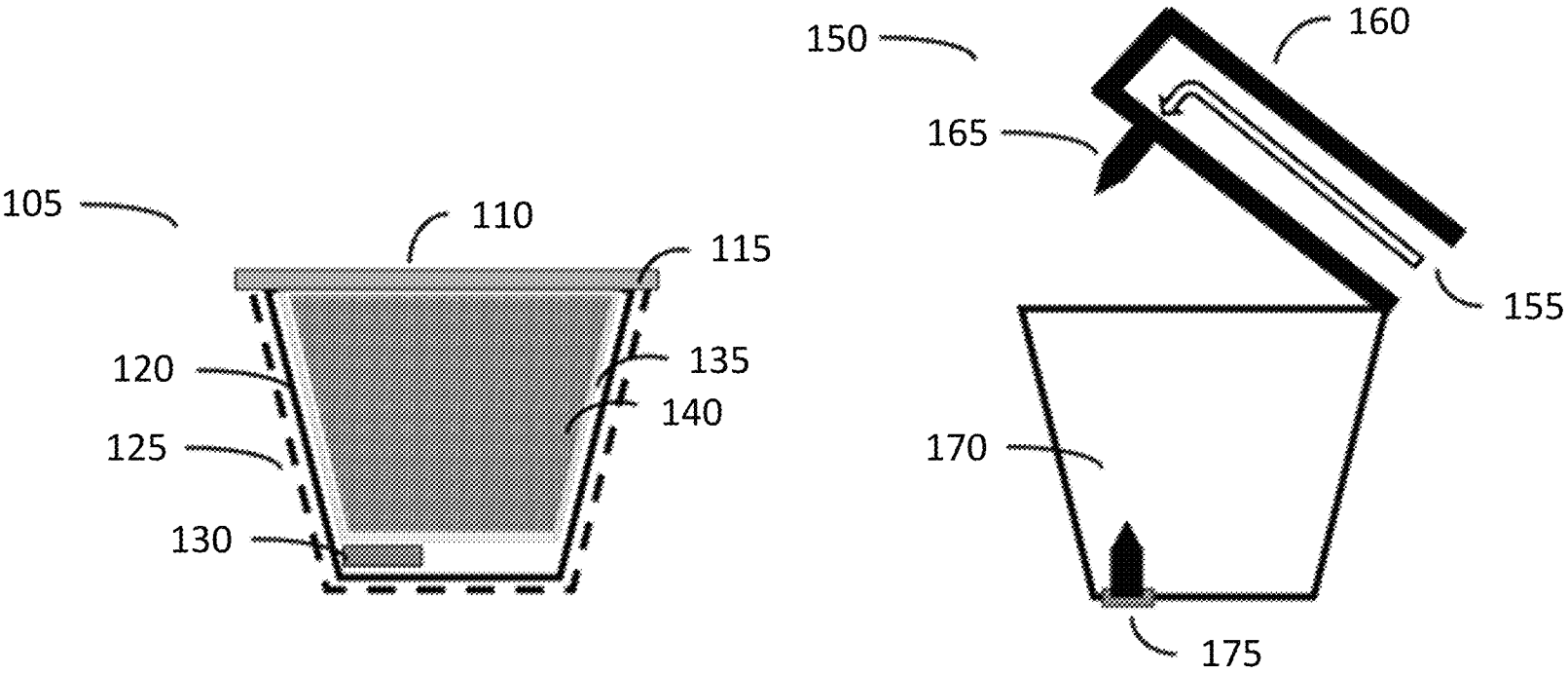
FIG. 1 depicts a block diagram of a compostable beverage pod or container of the present disclosure.

FIG. 1 depicts a block diagram of a compostable beverage pod or container of the present disclosure. The beverage container or pod 105 of FIG. 1 includes lid 110, bonding location 115, casing 120, optional outer coating 125, registration element 130, filter 135, and beverage materials 140 located inside of filter 135. FIG. 1 also illustrates beverage extraction/brewing machine assembly 150 used to extract elements included in a beverage container when a fluid is introduced into a brewing/extraction chamber 170. This fluid may be provided to the extraction/brewing assembly from fluid source 155 and through the beverage materials included in the beverage container. The beverage machine assembly 150 of FIG. 1 includes fluid source 155, extraction/brewing assembly chamber lid 160, brewing/extraction chamber 170, piercing element/nozzle 165 that receives fluid from fluid source 155, and outlet 175 that may also include an element that pierces a bottom portion of a beverage container.

In operation chamber lid 160 the beverage machine 150 would be opened, beverage cartridge 105 would be placed into chamber 170, chamber lid 160 would then be closed, and a button may be pressed to initiate the flow of a fluid (e.g. water) from fluid source 155 through piercing element/nozzle 165. The closing of lid 160 could force piecing elements of nozzle 165 and outlet 175 to pierce respectively a top part and a bottom part of beverage cartridge 105. Registration element 130 of beverage cartridge 105 may help prevent the piercing element of outlet 175 from reaching or piercing filter 135 in some embodiments, and in other embodiments, registration element 130 may cause the piercing element of outlet 175 to reach or pierce filter 135, the pierced portion of filter 135 thereby surround by a bond to registration element 130, preventing the beverage material 140 from escaping the pod 105 via the pierced portion of filter 135. Here the liquid flowing from fluid source 155 would flow through piercing nozzle 165 into the top of beverage cartridge 105, through filter 135, beverage materials 140, and out of outlet 175 when a beverage is made.

Beverage pod/cartridge 105 of FIG. 1 may include one or more of, a beverage medium that is either soluble or insoluble, one or more filters, and a first portion in which liquid is passed into and a second portion through which liquid passes out of the cartridge. In some instances, portioned beverage packages contain a water-soluble material, to make a drink such as hot chocolate, chai tea, etc. These portioned packages can be pouches as well as pods for beverage brewing machines. Beverage cartridges can contain a number of components, including pod lid, capsule lid, or cartridge lid. The lid of a beverage pod is often made of foil that may be glued to a bottom portion of a cartridge to seal a beverage material inside of the cartridge.

Cartridge lid 110 of FIG. 1 may be comprised of a compostable natural material, for example, a spun bond environmentally friendly plastic web film material (e.g., a material including polylactic acid (PLA), any polymer selected from the class of polymers known as polyhydroxyalkanoates (PHAs) (such as polyhydroxybutyrate (PHB), or a combination thereof), a cellulose paper film, or other type of compostable nonpolluting material. Lid 110 may be bonded to an upper portion/bonding location 115 of casing 120. In certain instances, filter 135 may be bonded to an internal surface of casing 125. These bonds may be a mechanical or chemical bond. Here a mechanical bond may be created using heat sealing or ultrasonic welding and a chemical bond may be created using a food grade adhesive. The bonding of a lid or a filter onto or into a case may include creating bods at in one location or may include several separate bonds at different locations of a case. A filter bond may be a type of capsule bond that binds the filter medium to a portion of the capsule. Here again this may include ultrasonic welding, adhesives, or thermal sealing. A capsule may include an exterior surface that is includes a series of holes, that includes portions of a filter element, or may be a filter material similar to a tea bag that contains a material for making a beverage.

While the beverage pod of FIG. 1 is discussed as including filter 135, in certain instances, a filter may not be used, for example, when the beverage making material is soluble.

In such an instance beverage making material 140 may be placed in beverage container/pod 105 without filter 135.

The process of manufacturing beverage cartridge 105 may include coating exterior portions of cartridge 105 with a coating 125 material. Coating 125 may have been applied as part of process where the coating is sprayed onto outer surfaces of cartridge 105. Alternatively, cartridge 105 may be placed into a mold and the coating 125 may be extruded into the mold when external surfaces of cartridge 105 are coated.

The exterior of cartridge 105 can be made of a non-polluting plastic (such as PLA, PHAs, PHB, or combinations thereof), cellulose, etc. Combinations of various materials (that may include PLA, PHA, PHB, or cellulose) have some properties that are similar to properties of petroleum based thermoplastic polymers (e.g. polypropylene (PP), polyethylene (PE), and polystyrene (PS)) and have other properties that are different from most petroleum based thermoplastic polymers. What this means is that items made from PLA, PHAs, PHB, and/or cellulose can have the look and feel of "plastic," yet biodegrade over a span of weeks or months, where items made from PP, PE, and PS, or other petroleum based thermoplastic polymers may not fully degrade over weeks, months, or even many years. This allows for beverage container made from PE, PHA, cellulose, and or other similar organic materials to serve as a biodegradable alternative to coffee pods made using petroleum based thermoplastic polymers.

PLA and PHA materials are renewable materials that may be produced using bacterial fermentation of sugar or lipids that may have been derived from corn, cassava, sugarcane, or sugar beet pulp. Mechanical properties of PHAs can be modified for a given use case by blending PHA material with other biodegradable polymers, such as PLAs. Other types of biodegradable materials from which plastic may be made include poly-L-lactide (PLLA). PLLAs are also considered to be compostable materials because of how quickly PLAA materials can degrade in the environment. Cellulose materials are made from fibers derived from plant matter. Cellulose may be collected by processing cotton, flax, wood pulp, hemp, and other plant materials. These various materials may be used to fabricate a biodegradable filter material that could be used in coffee or other beverage pods/cartridge. What this means is that non-petroleum based organic materials may be used to form various parts of a beverage cartridge.

Other materials that are biodegradable plastic alternatives include petroleum-based plastics such as, polyglycolic acid (PGA), polybutylene succinate (PBS), polycaprolactone (PCL), polyvinyl alcohol (PVOH) and polybutylene adipate terephthalate (PBAT). In certain instances, these other materials may be used to fabricate a portion of a beverage cartridge, for example, casing 120 of FIG. 1.

Filters included in a cartridge may be made of any of the materials or combination of materials discussed in the present disclosure in order to help insure that the entire cartridge biodegrades within weeks of months after being used. Beverage cartridges can also contain a capsule interior that is separate from a filter, in beverages that have an insoluble beverage material such as coffee. The capsule interior can be used for a number of purposes, including, providing material properties such as structural integrity (e.g., provide addition strength to resist the pressure of liquid injection in the process of brewing a beverage, which may crack or otherwise compromise the beverage pod), or altering the biodegradability or rate of the beverage pod in some embodiments. For example, coating 125 may be a material that alters the biodegradability of materials included in casing 120 or vice versa.

As mentioned above, registration element 130 is a structure integrated into a beverage pod that prevents or causes a sharp part of outlet 175 from piercing filter 135. In some embodiments, an interior of cartridge 120 may include integrated features to act as a registration element, removing the requirement for a discrete registration element 130. Filter 135 may be made from as spun bond PLA webbing material, cellulose paper, cloth, or metal. A main purpose of filter 135 and registration element 130 is to prevent an insoluble portion of a beverage material from leaving the beverage pod and entering the beverage brewing/extraction machine or a beverage made by a brewing machine. These filters can be symmetrical (e.g., fluted), or asymmetrical (e.g. pleated).

Here a beverage material is the material used to produce a brewed or extracted beverage, such as coffee grounds, tea, or a mix beverage where the beverage material is soluble, such as hot chocolate. Beverage materials may include flavorings, nutritional content (e.g., any oils, nutritional supplements, active ingredients such as pharmaceuticals, cannabinoids, etc.), alcohol, coloring, or any other composition which has an effect on the final beverage. Beverage brewing/extraction machines for making portioned beverages from pre-packed beverage pods exist for a variety of beverages. These beverage materials may include portions that are made insoluble (e.g., coffee) or may include materials that are completely soluble (e.g., hot chocolate mix).

A beverage brewing/extraction machine will typically contain many other components, such as, for example, a heating element, a liquid reservoir or plumbing component, a liquid pump, an exterior chassis, a controller for the brewing process, a display or indicator lights and sounds, a user interface including buttons or a touchscreen, a tray to catch spillage, etc. For the purposes of description, it is assumed a beverage brewing/extraction machine contains all components necessary to accomplish the beverage brewing process, though specific reference to beverage brewing machine components may only be made to those components which come into direct contact with the beverage pod, such as the brewing chamber, a fluid injecting component, and a fluid extracting component. A beverage brewing/extraction machine may include the following elements: A fluid source that supplies 155 a fluid or liquid (usually water) to the brewing machine for producing the desired beverage. A brewing chamber lid 160 that opens to allow a new pod to be added to the machine, and in many of the most common embodiments of a beverage brewing machine, the chamber lid 120 connects the fluid source 155 to the brewing piercing element/nozzle 165. As mentioned above nozzle 165 provides the fluid when a beverage is created. Here again chamber 170 may receive beverage container 105 and a piercing nozzle of output 175 may pierce the bottom of container 105 to allow the created beverage to flow through output 175.

A beverage pod may also include features that direct the flow of liquid to increase turbulence within a beverage pod. Such features may be referred to as an agitation device may direct the flow of fluid such to provide turbulence to either more effectively mix soluble materials with a fluid or to direct a fluid to more effectively extract elements from a non-soluble beverage material such as coffee grounds or tea leaves.

Figure 2B:
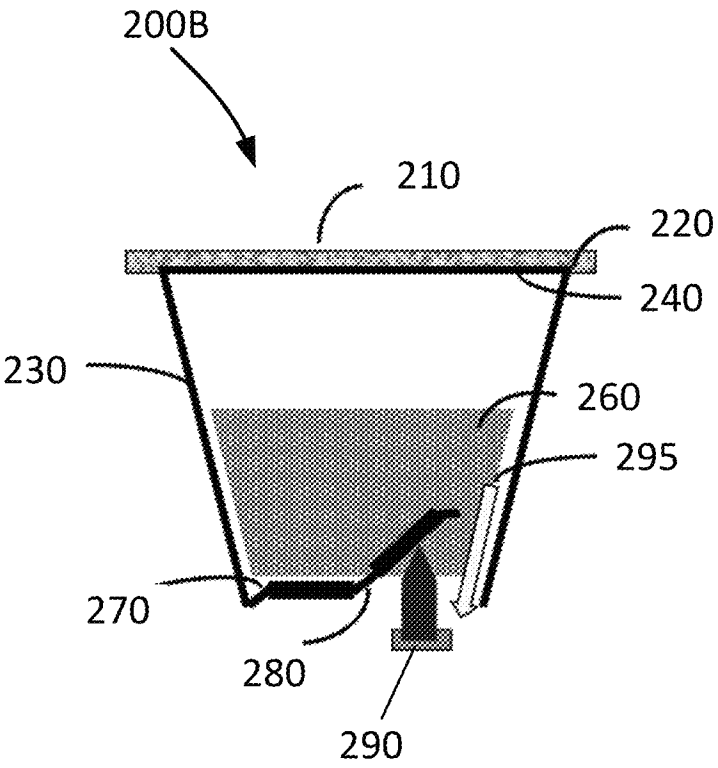
FIGS. 2A and 2B illustrate a beverage pod made with features that allow beverage making materials included in the beverage pod to escape the pod when a beverage is made.
Figure 2A:
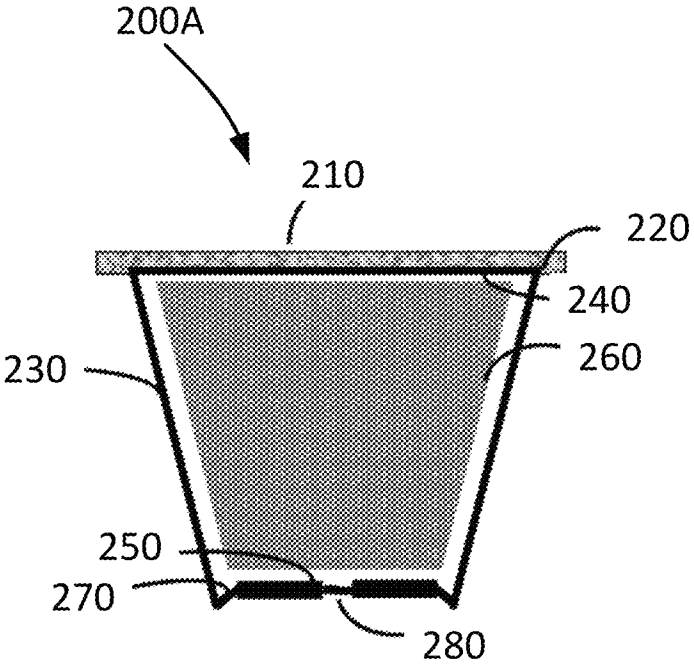

FIGS. 2A and 2B illustrate a beverage pod made with features that allow beverage making materials included in the beverage pod to escape the pod when a beverage is made.

The beverage pod of FIGS. 2A and 2B includes a pod lid 210, rim 220, side wall 230, bottom portion 250, and beverage making material 260.

Pod lidding material 210 may be affixed to the pod exterior at the beverage pod rim by a bond 240 that may have been formed using a thermal process or that is formed using a food grade adhesive. The pod lidding material may include any of a pressed fiber material such as wax paper or parchment paper, a plastic or cellulose film, or a foil material, for example. When affixed to the pod exterior by pod bond 240, the pod lid creates an airtight seal within the beverage pod. In some instances pod lid 210 may be made of wax paper. A pod bond is a means of attaching two or more components of a beverage pod to one another. The pod bond may be chemical, such as an adhesive, or mechanical such as an ultrasonic or thermal weld. For example, the pod bond 240 may be formed by an ultrasonic welding of a wax paper pod lid 210 to a rim 220 of the beverage pod that is made of a PLA material. The pod exterior is the primary structure of a beverage pod comprising at least of one or more side walls. The pod exterior may additionally include side wall 230, pod bottom 250. Here pod bottom 250 may include features of a first hinge 270 and a second hinge 280 that allow parts of the pod bottom 250 to break away and move away from side wall 230 of a beverage pod. FIG. 2A (210A) is an image of the beverage pod before it is used to make a beverage. FIG. 2B (210B) is an image of the beverage pod when a beverage is being made.

The pod exterior may be made of any material including PLA, PHA or PETG and may be further reinforced with natural or synthetic fibers. In certain instances, the pod exterior is a conical cylinder comprised of PLA including a continuous side wall and a beverage pod bottom which is characterized by at least one beverage pod bottom segment 250 affixed to the side wall 230 of the pod exterior by a side wall breakaway. The beverage pod rim 220 is a feature of a pod exterior characterized by a surface at least 0.2 millimeters (mm) wide along the top or bottom of the side wall of the pod exterior. The beverage pod rim 220 is typically made of the same material as the pod exterior walls 230. The beverage pod rim 220 is the location to which a pod lid may be attached to the pod exterior by a pod bond. In an embodiment, the beverage pod rim 220 is comprised of a 0.3 mm wide strip of PLA at the top of the pod exterior and is bonded to a wax paper pod lid 210 via an ultrasonic weld pod bond 240. The beverage pod bottom 250 is the bottom surface of the pod exterior walls 230. In some instances, the beverage pod bottom is comprised of the same material as the pod exterior walls 230.

The beverage pod bottom may be formed in the same process as the pod exterior. The beverage pod bottom may be formed by vacuum forming or alternatively by injection molding. The beverage pod bottom may alternatively be a discrete component formed separately from the pod exterior. In some instances, the beverage pod bottom is a comprised of a material different than the pod exterior. In an embodiment the beverage pod bottom is a discrete component comprised of a composite material of PLA and cellulose fibers which reinforced the beverage pod bottom relative to a pod exterior comprised solely of PLA. The beverage pod bottom may be formed such to resist puncture.

As mentioned above, the beverage pod bottom 250 may be designed to break away from side walls 230. Here this breakaway may be a radial breakaway or a center breakaway. The beverage pod bottom may be comprised of a pod lidding material that is designed to be punctured, torn, or ruptured by a beverage brewing machine outlet pin 290 at or near the point of contact with the beverage pod bottom. The beverage pod bottom 250 may be comprised of wax paper attached to the pod exterior 230 by a pod bond which tears when contacted by the outlet pin.

The soluble (or semi-soluble) beverage material 260 may be characterized by a degree or measure of solubility in a brewing fluid, which in many embodiments is water. The soluble beverage material 260 may be any of sugar, soluble flavorings, collagen, or whey protein, for example. In some embodiments, the soluble beverage material 260 may comprise non-soluble components which are not completely dissolved by the brewing fluid, but instead are suspended within the brewing fluid. For example, the soluble beverage material 260 may be a mixture of sugar and a soluble flavoring.

A sidewall breakaway area may be a boundary between the beverage pod bottom 250 and the pod exterior side walls 230 or other portions of the beverage pod bottom 250. A breakaway feature of a beverage pod may be characterized by a line of weakened material. Such a weakened material may comprise a beverage pod bottom 250 or pod exterior 230 material which is substantially thinner than the beverage pod bottom 230 and the pod exterior 250. A sidewall breakaway portion may have a thickness of no more than 0.2 mm, wherein other portions of the pod exterior may have a thickness of at least 0.5 mm. Other portions of the beverage pod bottom may have a thickness of at least 1 mm.

Alternatively, or additionally, the sidewall breakaway may include or be characterized by perforations. In such instances, the beverage pod bottom may further comprise a pod lidding material spanning the beverage pod bottom and affixed to the pod exterior via a pod bond such that an airtight seal is formed where the perforations would otherwise prevent the creation of an airtight seal. In yet other instances, a sidewall breakaway may be formed by an adhesive or other pod bond connecting the beverage pod bottom to the pod exterior.

The sidewall breakaway parts of a beverage pod may include a sidewall hinge, such as hinge 270. Sidewall hinge 270 may be similar to a sidewall breakaway that resists separation and instead deforms, typically by bending along the sidewall hinge. For example, sidewall hinge 270 may deform when pin 290 penetrates a bottom portion 250 of a beverage pod. At this time, hinge 280 may allow a part of the bottom of the beverage pod illustrated in image 200B to breakaway and move upward relative to other parts of the bottom of the beverage pod of FIGS. 2A and 2B. This may allow the beverage making material to exit the beverage pod with beverage flow 295 illustrated in image 200B of FIG. 2B.

In another example, a sidewall hinge 270 may have a thickness of at least 0.2 mm but no more than 8.4 mm when a pod exterior 230 has a thickness of at least 0.5 mm. Here again other parts of the beverage pod bottom may have a thickness of at least 1 mm. In such instances, the sidewall hinge 270 may be comprised of the same material as the pod exterior 230 and beverage pod bottom 250, however the sidewall hinge 270 may be further reinforced such as via the addition of natural or synthetic fibers.

A beverage pod may also include a center breakaway that may be a boundary between at least two segments of the beverage pod bottom 250. Here at least one segment may not contact the pod exterior directly. Alternatively, a center breakaway may be defined as a boundary between at least two segments of the beverage pod bottom which do not intersect a sidewall breakaway or a sidewall hinge. Such a center breakaway may be comprised of the same material as the beverage pod bottom which is substantially thinner than the beverage pod bottom 250. Here the beverage pod bottom may have a thickness of 1 mm of a PLA material, and the center breakaway may include a line of PLA that is no more than 0.2 mm thick. In such instances, the center breakaway may be formed by a mold applying heat and pressure along the center breakaway such that the material is plastically deformed. The center breakaway may further comprise a series of perforations.

The center breakaway may be formed by an adhesive pod bond attaching at least two beverage pod bottom segments to one another, where one part is thicker than another part. Alternatively, the center breakaway may be a center hinge which resists separation from adjacent beverage pod bottom segments. In another example, a beverage pod bottom is a 1 mm thick disk of PLA and the beverage pod bottom may include center hinge 280 that is a line of PLA at least 0.2 mm but no more than 0.4 mm thick. Center hinge 280 may be a center breakaway that does not separate when outlet pin 290 is in contacts the beverage pod bottom. The evacuation path 295 is the path of soluble material and brewing fluid created by the beverage pod outlet pin contacting the beverage pod bottom of the beverage pod. Upon contact with the outlet pin 295, at least a part of the beverage pod bottom 250 is forced to separate to create at least one opening larger than what would be created by the outlet pin piercing the beverage pod bottom. For example, an evacuation path may have an opening of at least 2 mm in the narrowest dimension created by the separation of the beverage pod bottom from the pod exterior at a side wall breakaway. An evacuation path may be created by the separation of a portion of the beverage pod bottom 250 from the pod exterior 230. The opening along which flow 295 moves prevents much of the beverage material 260 from exiting the beverage pod via the outlet pin 290, thus reducing the potential of outlet pin 290 clogging. The opening allows with flow 295 moves, thus helps prevent beverage materials from agglomerating in a hole included in outlet pin 290. Note that the flow 295 bypasses outlet pin 290 allowing much or all of beverage making material 260 to escape a beverage pod when a beverage is made.

Figure 3:
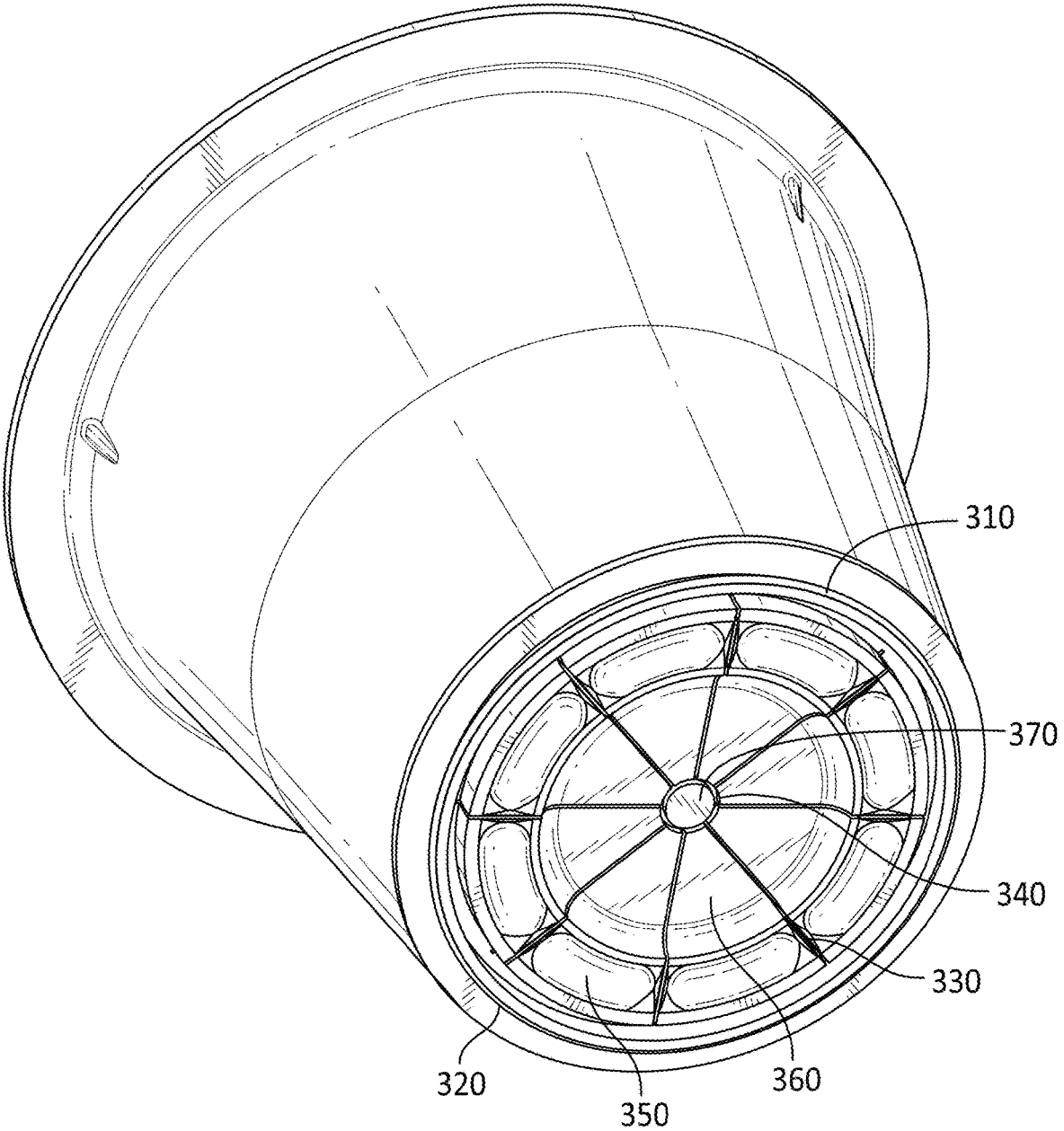
FIG. 3 illustrates features that may be incorporated in a bottom portion of a beverage dispensing container/pod.

FIG. 3 illustrates features that may be incorporated in a bottom portion of a beverage dispensing container/pod. FIG. 3 shows an exterior portion of the beverage pod bottom. The bottom portion 310 of FIG. 3 includes sidewall breakaway 320, radial breakaway 330, center breakaway 340, outlet pin capture 350, radial hinge 360, and center hinge 370. Note the various breakaways 320, 330, and 340 of FIG. 3 are lines that may be locations where the bottom of the beverage container is thinner or that have been embossed. Pressure exerted by an outlet pin of a beverage making machine and a force of compression by closing the top of a beverage brewing chamber lid, like lid 160 of FIG. 1, will deform and break the beverage pod along one or more breakaway lines 320, 330, or 340.

The outlet pin capture 350 a recessed region of FIG. 3 may be a location where an output pin of a beverage making machine impacts. The recession of this pin capture 350 region may prevent the output pin from puncturing the bottom 310 of a beverage pod. In instances when an output pin does not puncture the bottom 310 of a beverage pod, all of the flow of a liquid provided to the beverage pod by the beverage making machine will flow through a crack in the beverage pod that was created when the beverage making machine lid was closed. This flow may flow into a cup that a person has placed onto a surface of the beverage making machine.

Radial hinge 360 or center hinge 380 may act as hinges 270 and 280 discussed in respect to FIGS. 2A and 2B. These hinges may allow a crack formed in the surface of a beverage pod to open such that a flow of liquid and beverage making material can move through the crack and into a person's cup.

The beverage pod bottom may include an agitation device such that the flow of brewing fluid is redirected when it contacts the agitation device, improving the mixing of the soluble beverage material with the brewing fluid and reducing agglomeration of the beverage material. The agitation device may be a feature of the beverage pod bottom or a discrete component separate from the beverage pod bottom. In some instances, the beverage pod bottom may be a discrete component which may be mechanically or chemically bonded to the pod exterior using any of adhesives, heat sealing, ultrasonic welding, etc. The discrete beverage pod bottom or parts of the beverage pod bottom may be comprised of the same material as other parts of the beverage pod exterior. In some instances, the bottom of the beverage pod may be made of different materials than the pod exterior side portions. Increased agitation combined with escaping of a beverage making material from a beverage pod are features that help produce an improved beverage as compared to the use of conventional beverage pods that do not include built in agitation features or openings that allow beverage making materials to escape a beverage pod. This is because the increased agitation improves solubility and because most or all of the beverage making material will be introduced into a person's cup rather than remaining in a conventional beverage pod.

The beverage pod bottom may alternatively be a composite of multiple materials including the same material or possibly different materials as the pod exterior. In one instance, the beverage pod bottom and the pod exterior are both comprised of PLA. This beverage pod bottom may be configured to break away from the pod exterior at a side wall breakaway point or a break away points dispersed along the bottom of the beverage pod. In another instance, the entire beverage pod bottom may break away from the pod exterior side portion. The beverage pod bottom may be segmented into at least two sections. Here each section may be characterized by at least one breakaway part which may include any of a side wall breakaway 320, a radial breakaway 330, or a center breakaway 340.

In other instances, the beverage pod bottom segments are not radially segmented, but instead may comprise a grid of parallel lines or cross hatched lines that corresponding with breakaway parts of a beverage pod. These breakaways may be at least in part in contact with the beverage pod side wall, where a bottom portion of the beverage pod is configured to break away from a side wall part of the beverage pod.

These various breakaway portions may include a grid segmentation structure that may not be in contact with side wall of the beverage pod. Here again these breakaways may be radial breakaways 330 or center breakaways 340. Any breakaway part may include a hinge (360/370) that allows an opening to be formed in the bottom part of a beverage pod when an outlet pin of a beverage machine is pressed into the bottom of the beverage pod as illustrated in item 200B of FIG. 2B. Any breakaway which does not separate may act as a hinge like the hinges 270 and 280 of FIGS. 2A and 2B.

A hinge 360/370 may be intended to withstand the force of a beverage brewing machine outlet pin without separating or may be a breakaway as previously described which does not separate when force is applied by the outlet pin. The beverage pod bottom 310 may be a part of the pod exterior defined by a thinned ring of the pod exterior material, PLA. The thinned ring of pod exterior material forms a side wall breakaway which, when a force is applied to the beverage pod bottom, causes at least one segment of the beverage brewing pod bottom to separate from the pod exterior at the side wall breakaway corresponding with the segment making contact with the outlet pin.

The beverage pod bottom may be segmented into eight equal segments, as illustrated in FIG. 3. In some instances, one or more segments adjacent to the segment in contact with the outlet pin may separate from the pod exterior along their respective sections of the side wall breakaway. The segments may further separate completely or partially from the remaining beverage pod bottom at one or more radial breakaways. Here, the beverage pod bottom may remain attached at the center hinge. In other instances, a side wall breakaway may be replaced with a side wall hinge, and the beverage pod bottom segment in contact with the outlet pin separates at the center breakaway and the radial breakaway, remaining attached at the side wall hinge. In further instances, the beverage pod bottom segment in contact with the outlet pin may separate at the side wall breakaway 320, center breakaway 340, and one of two radial breakaways 330. Here, the second radial breakaway may remain attached to the rest of the beverage pod bottom, functioning as a radial hinge. In some instances, the beverage pod bottom forming a funnel or taper towards the outlet before, during and after being contacted by the outlet pin such that the soluble beverage material is moved towards the outlet created when at least one of a side wall breakaway, radial breakaway or center breakaway separates. Similarly, any breakaway including any of a side wall breakaway, radial breakaway and center breakaway, may act as a hinge, including any of a side wall hinge, radial hinge or center hinge, if the breakaway fails to separate from the pod exterior or the remaining beverage pod bottom.

A side wall breakaway 320 may be a boundary between the pod exterior and the beverage pod bottom. The side wall breakaway 340 may be designed to separate from the pod exterior when the beverage pod bottom is contacted by the beverage brewing machine outlet pin. In alternative embodiments, the side wall breakaway 340 may be replaced by the side wall hinge. The side wall hinge 320 forming the boundary between the pod exterior and the beverage pod bottom 310. Alternatively, the side wall hinge 320 may be a side wall breakaway which does not separate from the beverage pod bottom when contacted by the outlet pin. The side wall breakaway may be comprised of the same material as the pod exterior and the beverage pod bottom.

A side wall breakaway 320 may be comprised of the same material as the pod exterior and the beverage pod bottom, PLA, however the PLA along the side wall breakaway may be less than 0.4 mm whereas the beverage pod bottom may be at least 2 mm thick and the beverage pod exterior is at least 1 mm thick. In other instances, a side wall breakaway may be replaced by a side wall hinge which is similarly formed by PLA thinner than the pod exterior and beverage pod bottom, however the side wall hinge may be less than 0.8 mm, but greater than 0.4 mm such that the side wall hinge will deform but will resist separation when the beverage brewing machine outlet pin contacts the beverage pod bottom. The side wall breakaway 320 may alternatively be perforated. The side wall breakaway may alternatively be comprised of an adhesive material, such that the beverage pod bottom is secured to the pod exterior via the adhesive. A radial breakaway 330 may be the boundary between beverage pod bottom segments along lines from the outer edge of the beverage pod bottom intersecting with a side wall breakaway or a side wall hinge, to the center of the beverage pod bottom, perpendicular to the circumference of the beverage pod bottom. The radial breakaway 330 may not extend to the center of the beverage pod bottom, but instead may intersect perpendicular to a center breakaway or a center hinge 370. The radial breakaway 330 may instead be a radial hinge 370. The radial hinge 360 remaining attached to the adjacent beverage pod bottom segment and bending at the radial hinge 360. In some instances, the radial breakaway or radial hinge is comprised of the same material as the beverage pod bottom, however the radial breakaway or the radial hinge is substantially thinner than the beverage pod bottom.

In some instances, the beverage pod bottom is comprised of PLA and a radial breakaway that is no more than 0.5 mm thick while the beverage pod bottom is at least 2 mm thick. In another instance, the beverage pod bottom is comprised of PLA and a radial hinge is no less than 0.5 mm while the hinge is no more than 1 mm and the beverage pod may be at least 2 mm thick. Alternatively, the radial breakaway may comprise perforations of the beverage pod bottom. In alternate embodiments, a radial breakaway may instead be comprised of an adhesive or pod bond between at least two adjacent beverage pod bottom segments.

The center breakaway may be the boundary between a center segment of the beverage pod bottom and other segments of the beverage pod bottom. The center segment of the beverage pod bottom is characterized by not being connected to the pod exterior of the beverage pod but may be instead surrounded by other segments of the beverage pod bottom. One or more radial breakaways or radial hinges may intersect with the center breakaway perpendicular to the center breakaway.

In some instances, the center breakaway 340 is a center hinge 370 when the center breakaway does not separate from a segment of the beverage pod bottom. The center breakaway 340 may be comprised of the same material as the beverage pod bottom, PLA, which is less than 0.5 mm thick where the remaining portions of the beverage pod bottom not comprising a breakaway or hinge is at least 2 mm. In other instances, the center hinge may be at least 0.5 mm but no more than 1 mm while the remaining portions of the beverage pod bottom not comprising a breakaway or hinge is at least 2 mm. In further instances, the center breakaway 340 may be perforated. Alternatively, the center breakaway may comprise an adhesive or pod bond attaching the center segment to other beverage pod bottom segments at a center breakaway.

An outlet pin capture 350 is a feature or region on the exterior of the beverage pod bottom designed to capture the outlet pin of a beverage brewing pod such that the outlet pin will not slip outside of the feature or region. The outlet pin capture 350 may be any of a ridge or series of multiple ridges or an indentation in the bottom of the beverage pod bottom. When the beverage pod bottom is comprised of more than one segment separated by radial breakaways or radial hinges, each beverage pod bottom segment may have its own discrete outlet pin capture. Such an outlet pin capture 350 may have an indentation of at least 1 mm in the bottom of the beverage pod bottom. In further instances, the outlet pin capture additionally includes multiple ridges, each rising at least 0.5 mm from the deepest part of the indentation. The outlet pin capture may be formed into the exterior of the beverage pod bottom and may therefore comprised of the same material as the beverage pod bottom. In some instances, the outlet pin capture is comprised of PLA. The outlet pin capture 350 may be comprised of alternate materials intended to reinforce the outlet pin capture to resist puncture or deformation. Such reinforcing materials may include cellulose fibers. In other instances, the outlet pin capture serves to prevent beverage material from exiting the beverage pod via the outlet pin thus preventing the beverage material from clogging the outlet pin and causing a potential failure of the beverage brewing machine.

A beverage pod bottom segment is a segment of the beverage pod as bounded by any of a side wall breakaway 320, a radial breakaway 330, a center breakaway 340 or a side wall hinge, a radial hinge 360, or a center hinge 370. The beverage pod bottom may comprise a single segment bounded by a side wall breakaway.

The beverage pod bottom may be divided into at least two beverage pod bottom segments separated by at least two radial breakaways and further surrounded by at least two side wall breakaways. Alternatively, one or more side wall breakaways may be replaced by a side wall hinge or one or more radial breakaways may be replaced by a radial hinge. A center segment may be a beverage pod bottom segment which does not contact the pod exterior of a beverage pod at a side wall breakaway or a side wall hinge. The center segment may be surrounded by at least one other beverage pod bottom segment, meeting at a center breakaway or center hinge.

A center segment may be surrounded by one, donut shaped, beverage pod bottom segment. In further instances, the center segment is surrounded by at least two beverage pod bottom segments, each beverage pod bottom segment separated by a radial breakaway or a radial hinge. Typically, the center segment will remain attached to at least one other beverage pod bottom segment at a center hinge.

Figure 4:
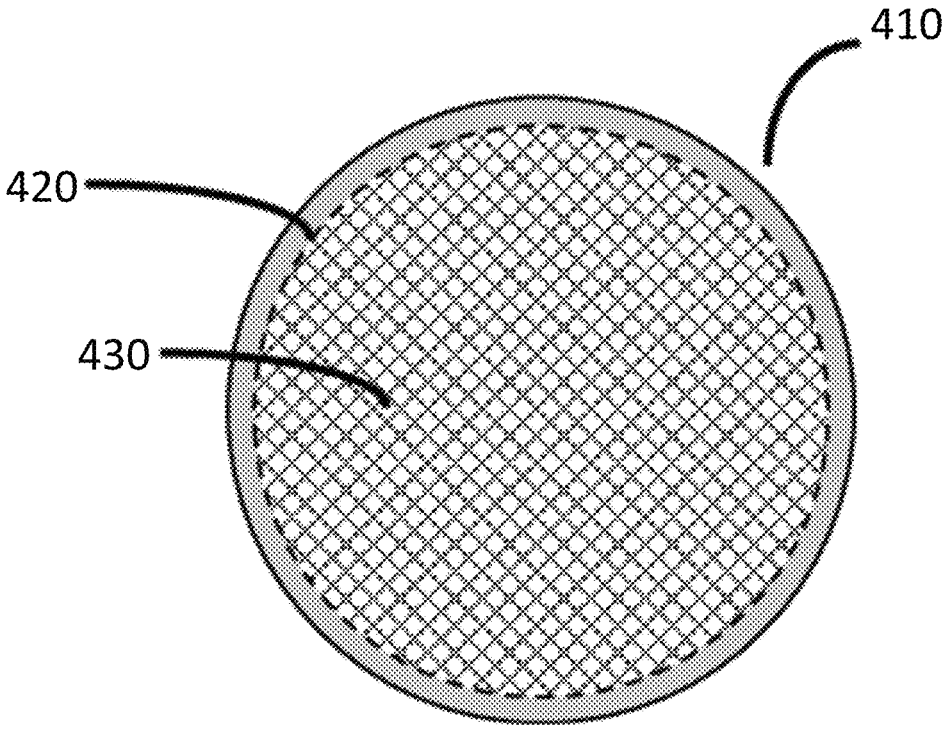
FIG. 4 illustrates a structure that may be incorporated in a rupturable bottom portion of a beverage container.

FIG. 4 illustrates a structure that may be incorporated in a rupturable bottom portion of a beverage container. FIG. 4 illustrates the rupturable pod bottom 410 that includes a bottom lidding material 420 that may be affixed to the pod exterior by a bond. When an outlet pin of a beverage machine presses on or punctures the bottom of the rupturable pod bottom 410 of FIG. 4, a portion of the pod bottom 430 will break away creating an opening that allows a portion of the beverage making material to escape the pod by bypassing a hole included in the outlet pin of the beverage machine. The hole created in the bottom of the pod will be substantially larger than a hole in an outlet pin. Rupturing of a part of a beverage pod may include the bursting of a surface under tension in a dynamic almost explosive way. Much like the bursting of an inflated balloon, a ruptured surface under tension releases potential energy similar to releasing a spring under tension.

A hole or opening created in the bottom of the pod may have a dimension of least 4 mm in its narrowest dimension. The size of a hole in a typical beverage making machine is less than 2 mm in diameter. As mentioned above, the pod bottom 410 of FIG. 4 may be bonded to the bottom of a beverage pod and this bottom may be a sold piece that is bonded to a side portion of a beverage pod subassembly. Such bonds are a means of attaching two or more components of a beverage pod to one another along an outer ring zone 420 of pod bottom 410. A pod bond is intended to create an airtight seal between the beverage pod components being attached to one another. The pod bond may be formed using an adhesive, or mechanical ultrasonic weld, or a thermal weld.

As discussed above the beverage container/pod bottom portion 410 of FIG. 4 may be a attached to a side portion of a beverage pod subassembly that may be attached in a manner similar to how lids of beverage pods are commonly attached to another portion of a beverage pod. The material used to make the pod bottom may be a thin material that is attached to an exterior surface of a side portion of a pod. This may include applying a tension to the pod bottom and affixing the pod bottom portion to the pod side portion using an adhesive.

When the pod bottom is ruptured by a beverage machine outlet pin, the pod bottom may tear, creating a substantially larger opening than would be created by the outlet pin puncturing the beverage pod bottom. When this pod bottom portion is rigid based on being under tension the outlet pin may easily rupture the pod bottom. As mentioned above the rupturing of a part of a beverage pod may be the bursting of a surface under tension, much like the bursting of an inflated balloon. In a surface under tension, a hole formed in that surface will allow tension of the surface to pull apart the surface with a rapid almost explosive way. This rupturing may occur after the beverage pod is placed in a beverage making machine and after a lid of that machine is closed. Here, the closing of the beverage machine lid may force an inlet pin to punch through a top portion of the beverage pod. The closing of this lid may also compress the beverage pod such that the outlet pin presses into the bottom part of the beverage pod causing the beverage pod bottom to rupture along the cross hatches 430 included in the pod bottom 410. These cross hatches 430 may be areas of the pod bottom 410 that is thinner than areas of the pod bottom 410 that are adjacent to the cross hatches 430.

Such a rupturable bottom lidding material may be stretched across the entirety of the bottom of the rupturable pod bottom or may comprise a portion of the rupturable pod bottom. In an instance, the rupturable lidding material creates an airtight seal over a hole in the rupturable pod bottom, the rupturable lidding material may have been attached to the rupturable pod bottom via a pod bond.

The rupturable pod bottom may further include more than one region wherein the rupturable lidding material creates an airtight seal over a hole in the rupturable pod bottom. In further instances, the rupturable lidding material may comprise a compressed fiber material such as wax paper or parchment paper. In such instances, the rupturable lidding material may be resistant to punctures such that it will typically tear when contacted by the outlet pin. In one such instance, the wax paper rupturable lidding material spanning the entirety of the rupturable pod bottom is at least 0.1 mm thick, and the tear in the material propagates such that the tear is at least 1 cm in its longest dimension and at least 0.2 mm in the widest part of the narrowest dimension. The tear may propagate radially from the outlet pin in more than one direction. Further, the one or more tears may not propagate in a predictable manner, however. Even so, the size of these tears will consistently be larger than this size of a hole in a beverage machine outlet pin. In some instances, the rupturable bottom lidding material may be include of tear lines 430, which may be thinner or perforated. Such tear lines 430 may be a seam secured by adhesive or a pod bond, such that the rupturable lidding material will fail along the tear lines. The rupturable bottom lidding material may alternatively comprise a film or foil material.

Figure 5:
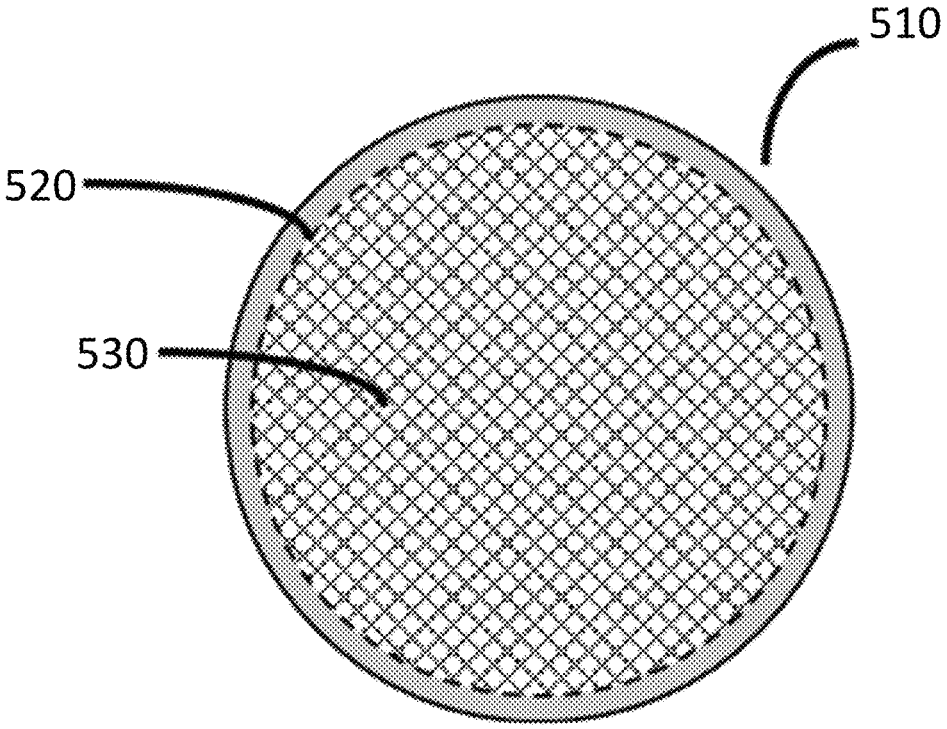
FIG. 5 illustrates a mesh that may be included in a portion of a pod bottom.

FIG. 5 illustrates a mesh that may be included in a portion of a pod bottom. FIG. 5 shows a sealed mesh pod bottom 510 which is a beverage pod bottom comprising a sealed mesh 530 affixed to the pod exterior of a beverage pod by a bond at location 520. The sealed mesh 530 may be made a composite of a sealing component, such as a pod bottom lidding material, and a structural component comprising any of a mesh, mixing device, or agitation device. Such a mixing or agitation device may direct the flow of a fluid provided to a beverage pod when a beverage is made.

The sealed mesh pod bottom 510 may be a mesh comprised of PLA and a sealing component comprising wax paper which are sealed to the pod exterior by a pod bond. This wax paper may cover mesh 530 and the wax paper may be bonded to surface 520 to form a seal. Here again the mesh may be bonded using an ultrasonic welding of a PLA material to a PLA pod exterior and a wax paper sealing material. Upon rupturing of the sealing component by the beverage brewing machine outlet pin, the brewing fluid and soluble brewing material can flow through the mesh while the mesh remains intact. In such instances, there may be a gap between an outer seal and the mesh 530. The mesh may be displaced upward into the beverage pod such as to resist failure due to contact with the outlet pin. Alternatively, the mesh may be a separate element from the sealing component such that the sealing component and the mesh component are never in contact. The mesh component may further comprise a filter or be protected from damage by a registration element, such as the registration element 130 of FIG. 1. In such an instance, mesh 530 may be located above registration element 130 of FIG. 1.

As mentioned above pod bond is a means of attaching two or more components of a beverage pod to one another. In many instances, a pod bond is intended to create an airtight seal between the beverage pod components being attached to one another. A pod bond may be used to attach the components of a mesh and a pod bottom lidding material, to one another. This bond or another bond may be used to attach the sealed mesh structure to the pod exterior. These bonds may once again be formed using an adhesive, an ultrasonic weld, or a thermal weld. A sealed mesh is a composite structure comprising a mesh and a pod lidding material. The pod lidding material may be any of a wax paper, parchment paper, plastic or cellulose based film, or a foil. The mesh component may comprise a mesh, creating a strainer effect, with the mesh gratings creating openings at least 1 mm in the narrowest dimension and no more than 2 mm in the widest dimension.

Alternatively, the pod bottom lidding material may be replaced with a solid disk which may be attached to the mesh via a pod bond such as to create an airtight seal. This solid disk may be similar to registration element 130 of FIG. 1 yet may be larger than registration element 130 of FIG. 1. When contacted by the outlet pin, this solid disk may be displaced into the beverage pod while the mesh remains in place. In an embodiment, the solid disk and the mesh are both comprised of PLA. The mesh may act as an agitation or mixing device that creates turbulence when a fluid that contains beverage making material particles flows through the mesh. In such embodiments, the mesh may include fins or other structures intended to create turbulence and improve mixing of the soluble beverage material.

Figure 6:
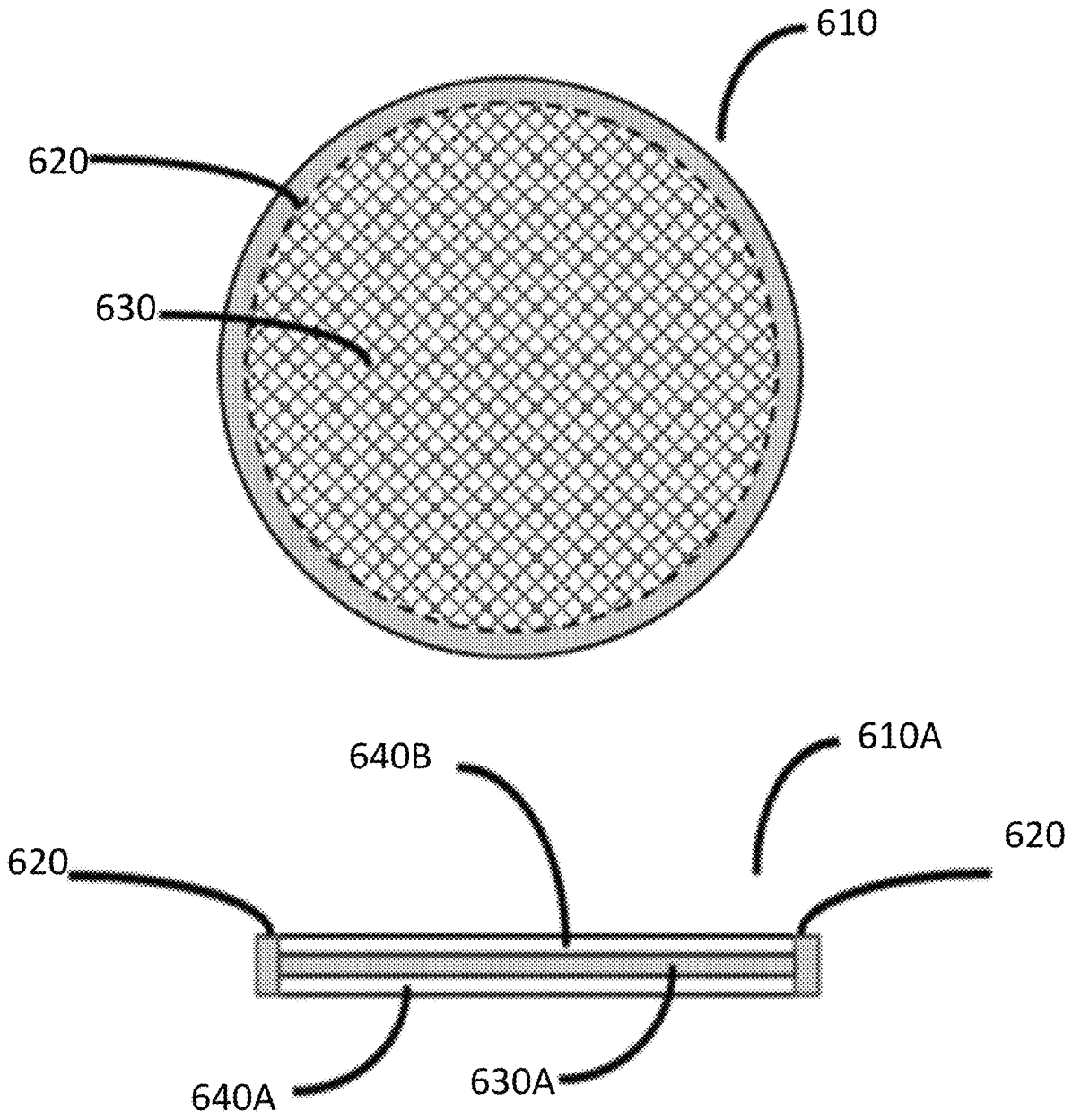
FIG. 6 illustrates a bottom portion of a beverage container/pod that includes frangible elements and filter elements.

FIG. 6 illustrates a bottom portion of a beverage container/pod that includes frangible elements and filter elements. FIG. 6 shows a frangible seal pod bottom 610 comprising a frangible seal 630 which is bonded to the pod exterior via a pod bond at location 620. A side view of the frangible seal pod bottom 610A may include at least one filter 640A located beneath the frangible seal such to prevent any fragments of the frangible seal from exiting the beverage pod with the beverage fluid and soluble beverage media. The side view of frangible seal pod bottom 610A may further include a second filter 640B opposite the first filter 640A, wherein the first and second filter (640A/640B) completely contains the frangible seal 630A before, during and after points in time when the frangible seal 630 is broken. The frangible element 630 may be a brittle material that cracks into pieces to allow a flow of a beverage to move through pod bottom 610. These pieces disposed between filters 640A & 640B may act to agitate beverage particles used to make a beverage. Brittle materials may be made of natural polymers such as cellulose, PLA, PBAT, or other naturally derived materials.

The frangible seal pod bottom's 610 components may be attached to one another via a pod bond and are similarly attached to the pod exterior via a pod bond at locations 620. In some instances, the one or more filters (640A/640B) are laminated to the frangible seal to prevent pieces of the frangible seal from exiting the beverage pod with the beverage fluid and soluble beverage media. In an embodiment, the frangible seal pod bottom 610 includes a frangible seal 630 comprised of PLA and a first filter made of cellulose fibers located beneath the frangible seal and a second filter made of cellulose fibers located above the frangible seal 630. The filters (640A/640B) and the frangible seal 630 may have been bonded to the pod exterior in such manner that it captures the first and second filter. Here again a pod bond is a means of attaching two or more components of a beverage pod to one another using various means. These bonds may be at location 620 and may attach the frangible seal 630 to the filter elements of FIG. 6 and to side portions of a beverage pod.

In some instances, the frangible seal may be comprised of PLA and the at least one filters 640A may be comprised of cellulose fibers. The frangible seal 630 and at least one filter further 640A may have been bonded to one another by a pod bond. Here again these elements may be welded or they may have been made as a laminate. The filter 640A may comprise cellulose fibers or a thin film. A filter may be a mat of fibers or a mesh such that the smallest piece of a broken frangible seal cannot pass through the filter. The filter may be a mesh comprised of a wire-like material, preferably a composable material such as PLA, cellulose, or any polymer selected from the group of PHAs. In other instances a filter may be a mat of cellulose fibers, or the filter may be adhered to the frangible seal to create a laminate coating. Such a laminate coating may comprise any previously disclosed embodiments of the filter or a film such as cellophane. The filter 640A being affixed to at least a portion of the frangible seal 630A.

Alternatively filter may be affixed to both sides of the frangible seal, creating a frangible seal with a laminate coating on both sides such that pieces of the frangible seal are captured when the frangible seal is broken. In alternate embodiments, the pore size of the filter may be selected based on the particle size of the beverage material and further agglomerating properties of the beverage material such that the beverage material is sufficiently mixed into the brewing fluid while ensuring at least 80% of the beverage material exits the beverage pod. For example, the particle size may be 0.5 mm and the pore size may be 0.1 mm. A frangible seal is a pod bottom comprising a brittle material. The frangible seal may be characterized by little or no elastic deformation before undergoing significant plastic deformation when the frangible seal is contacted by the beverage machine outlet pin. The frangible seal (that may be made of PLA) may have been fractured or broken into at least one piece in which at least a portion separates from the pod. The frangible seal further forming an airtight seal when bonded to the pod exterior via a pod bond at location 620.

Figure 7:
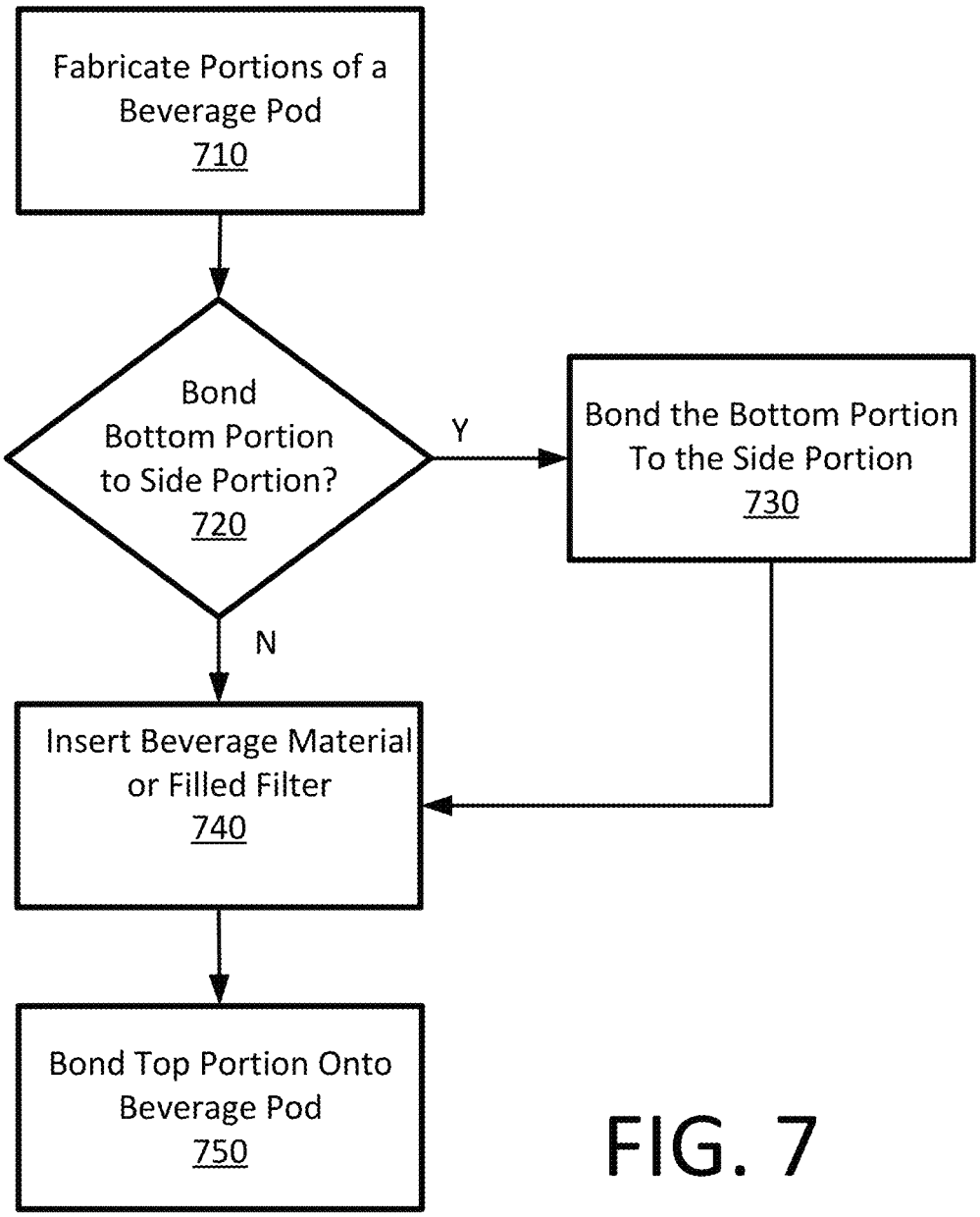
FIG. 7 illustrates a series of steps that may be used to make a beverage dispensing container/pod.

FIG. 7 illustrates a series of steps that may be used to make a beverage dispensing container/pod. FIG. 7 begins with step 710 where portion of a beverage pod may be fabricated. This may include making a top portion, a bottom portion, and a side portion of the beverage container. In certain instances, step 710 may include making a top portion and a second portion of the beverage container in the form of a cup that includes both side walls and a bottom of the beverage pod. This may include heating the pod making material and forming that heated material in a form. This pod making material may be a biodegradable thermoplastic material such as PLA or PHA, which may or may not include fibers of natural or composite materials. The forming process may be performed vacuum thermoforming around a form in the shape of a negative space of the beverage pod. The form may alternatively be in the shape of the exterior of the beverage pod. In yet other instances, the pod may be formed via injection molding where a heated thermoplastic material is injected into a mold. After cooling, the thermoplastic material may be cooled such that it retains the shape of the mold.

The pod may also be comprised of natural or composite fibers which may be pressed into a mold. When the pod is formed by vacuum forming using a sheet of PLA over a conical cylinder form, formed pod may further have any excess plastic removed by a cutting instrument that may additionally be heated.

In one instance, PLA is heated until melted and is extruded through at least one hole in an extrusion die resulting in at least one strand of thin plastic which is deposited on a plate to cool. A layering of these extrusions, resulting in a mat of threads with a porosity size smaller than that of the grain size of the beverage material, a process known spun or spin bonding.

The process of making the portions of the beverage pod may include forming or molding parts of these portions with different thicknesses. For example, a mold may have protrusions and recessions that correspond to thin and thicker features of a bottom of a pod. Alternatively, or additionally this process may include pressing a bottom portion of the pod onto a set of protrusions on a surface that emboss patterns onto a surface of the bottom portion of the pod. As discussed above, these thickness differences or embossments may be areas where the beverage pod is designed to crack when the beverage pod is placed into a beverage making machine.

After step 710, program flow may move to step 720, that identifies whether a bottom portion needs to be bonded to a side portion of the beverage pod, when yes program flow may move to step 730 where the bottom portion is bonded to the side portion. As discussed above, this bonding may be performed using adhesives, ultrasonic bonding, or thermal bonding. When determination step 720 identifies that a bottom portion does not need to be bonded to a side portion of the beverage pod method may move to step 740 of FIG. 7. This may occur when the beverage pod is formed or molded into a cup shape that includes both side walls and a bottom.

The method of FIG. 7 may move to step 740 after step 730 of FIG. 7. Step 740 is a step where a beverage material or a filter filled with beverage material may be placed in the beverage pod. Next in step 750, the beverage pod may be completed by bonding a top portion of the beverage pod onto another part of the beverage pod.

While various flow diagrams provided and described above may show a particular order of operations performed by certain embodiments of the invention, it should be understood that such order is exemplary (e.g., alternative embodiments can perform the operations in a different order, combine certain operations, overlap certain operations, etc.).

The foregoing detailed description of the technology herein has been presented for purposes of illustration and description. It is not intended to be exhaustive or to limit the technology to the precise form disclosed. Many modifications and variations are possible in light of the above teaching. The described embodiments were chosen in order to best explain the principles of the technology and its practical application to thereby enable others skilled in the art to best utilize the technology in various embodiments and with various modifications as are suited to the particular use contemplated. It is intended that the scope of the technology be defined by the claim.

What is claimed is:

1. A container for dispensing a beverage, the container comprising:

a pod including a top portion configured to receive a liquid from a beverage machine;

a sidewall;

a bottom portion that includes a first part extending from a center of the bottom portion to the sidewall, wherein the first part is configured to break away from a second part of the pod and move away from an adjacent region of the sidewall when an outlet of the beverage machine presses into the first part, wherein the breaking away of the first part from the second part of the pod creates an opening at least partially defined by the sidewall; and a chamber space; and a beverage making material that is sealed within the chamber space, wherein the first part is configured to rotate upwardly to form the opening, through at least a portion of the beverage making material, and away from the sidewall to define an exit flow path directly between the first part and the sidewall when pressed upon by the beverage machine;

wherein a portion of the beverage making material and the liquid flows along the sidewall via the exit flow path and exits the chamber space via the opening bypassing the outlet of the beverage machine when the liquid is received via the top portion, thereby preventing the beverage making material from remaining in the chamber space.

2. The container of claim 1, further comprising a side portion that is attached to the top portion by a bond.

3. The container of claim 1, wherein the first part breaks away from the second part based on different material thicknesses.

4. The container of claim 1, further comprising embossments located at the bottom portion, wherein the first part breaks away from the second part based on the embossments located at the bottom portion.

5. The container of claim 1, wherein the bottom portion includes the second part.

6. The container of claim 1, wherein the sidewall includes the second part.

7. The container of claim 1, further comprising a mesh located at the bottom portion through which the portion of the beverage making material moves when exiting the beverage container.

8. The container of claim 1, further comprising a surface that directs the portion of the beverage making material to mix with the liquid to increase agitation and reduce agglomeration of the beverage making material.

9. The container of claim 1, wherein the bottom portion includes a frangible element.

10. The container of claim 1, wherein the bottom portion includes an element that is under tension that stores a potential energy, and the potential energy of the tension is released based on the breaking away of the first part from the second part.

11. A container for dispensing a beverage, the container comprising:

a side wall; and a bottom wall bonded to the side wall, wherein the bottom wall is attached to a breakaway feature that breaks away from the bottom wall upon being pressed, wherein the breakaway feature leaves an opening at least partially defined by the side wall in the bottom wall upon being broken away and allows a portion of the bottom wall to move away from the side wall to form an exit flow path between the portion of the bottom wall and the side wall; and a chamber space configured to hold a beverage making material, wherein the portion of the bottom wall is configured to rotate upwardly through at least a portion of the beverage making material held in the chamber space and away from the side wall after the breakaway feature is broken, thereby allowing the beverage making material and liquid delivered into the chamber space to flow along the exit flow path, along the side wall in a direction toward the opening, and exit the chamber space via the opening.

12. The container of claim 11, wherein a thickness of the breakaway feature is thinner than a thickness of the bottom wall.

13. The container of claim 11, wherein the breakaway feature includes an embossment, and wherein at least one part of the bottom wall does not include an embossment.

14. The container of claim 11, further comprising a top portion bonded to the side wall.

15. The container of claim 11, further comprising a mesh bonded to the bottom wall.

16. The container of claim 11, wherein the side wall and the bottom wall are configured to enclose at least one chamber.

17. The container of claim 11, further comprising a plurality of outlet pin capture recesses positioned circumferentially along the bottom wall, wherein at least one of the outlet pin capture recesses is configured to receive an output pin of beverage machine that causes the breakaway feature to break away from the bottom wall.

18. The container of claim 11, wherein the bottom wall includes a plurality of hinged flaps each having an outlet pin capture recess configured to receive an output pin of beverage machine, wherein the portion of the bottom wall is part of one of the hinged flaps.

* * * * *